US008256917B2

(12) United States Patent
Gammell et al.

(10) Patent No.: US 8,256,917 B2
(45) Date of Patent: Sep. 4, 2012

(54) SECURITY SAFE LIGHT MODULE

(76) Inventors: Michael W. Gammell, Spanish Fork, UT (US); Ricky Lynn Brittain, Spanish Fork, UT (US); C. Russell Shaw, Springville, UT (US)

( * ) Notice: Subject to any disclaimer, the term of this patent is extended or adjusted under 35 U.S.C. 154(b) by 112 days.

(21) Appl. No.: 12/767,798

(22) Filed: Apr. 26, 2010

(65) Prior Publication Data

US 2010/0271808 A1 Oct. 28, 2010

Related U.S. Application Data

(60) Provisional application No. 61/172,415, filed on Apr. 24, 2009.

(51) Int. Cl.
*F21L 4/04* (2006.01)

(52) U.S. Cl. ..... 362/191; 362/100; 362/28; 362/29; 362/398; 362/800

(58) Field of Classification Search ..... 362/191, 362/100, 28, 200, 368, 398, 249.02, 23, 29; 70/278.1, 454

See application file for complete search history.

(56) References Cited

U.S. PATENT DOCUMENTS

| | | | | | |
|---|---|---|---|---|---|
| 2,661,417 | A * | 12/1953 | Blackburn et al. | ..... | 362/189 |
| 4,293,894 | A * | 10/1981 | Blank | ..... | 362/100 |
| 4,310,873 | A * | 1/1982 | Bean | ..... | 362/100 |
| 4,475,067 | A * | 10/1984 | Rowe | ..... | 315/360 |
| 6,278,366 | B1 * | 8/2001 | Fletcher et al. | ..... | 340/542 |
| 6,439,732 | B1 * | 8/2002 | Weisbach et al. | ..... | 362/100 |
| 6,447,139 | B1 * | 9/2002 | Wilkes | ..... | 362/100 |
| 6,655,811 | B2 * | 12/2003 | Weisbach et al. | ..... | 362/100 |
| 8,021,012 | B2 * | 9/2011 | Dunbar | ..... | 362/100 |
| 2009/0190331 | A1 * | 7/2009 | Smith | ..... | 362/100 |
| 2011/0128723 | A1 * | 6/2011 | Coleman et al. | ..... | 362/183 |

* cited by examiner

*Primary Examiner* — Jong-Suk (James) Lee
*Assistant Examiner* — Leah S Macchiarolo
(74) *Attorney, Agent, or Firm* — Angus C. Fox, III

(57) ABSTRACT

Five embodiments of security safe light modules are disclosed which provide dedicated, low-power light modules for illuminating, on demand, the combination lock of security safes and, particularly, the combination lock of a security safe designed to store firearms. Several embodiments are designed to magnetically or adhesively adhere to the outer surface of the steel access door of a safe immediately above the combination lock dial or keypad, while others are designed to be permanently sandwiched between the outer surface of the access door and the combination lock which is secured to the door's outer surface with screws accessible from the inside of the safe. All embodiments include a housing preferably made of polymeric structural resin, a 3-volt lithium coin cell, a light emitting diode, and a switch. Certain embodiments provide a timed circuit which automatically shuts off power to the LED.

4 Claims, 14 Drawing Sheets

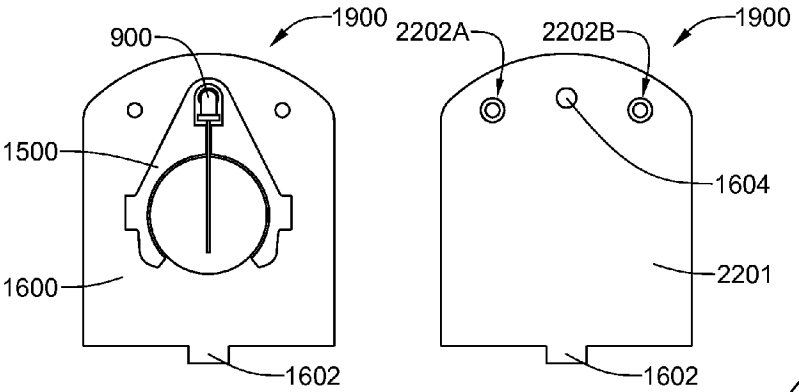
FIG. 21
FIG. 22
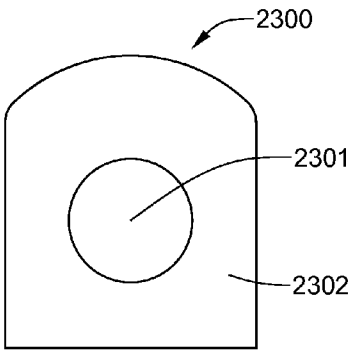
FIG. 23
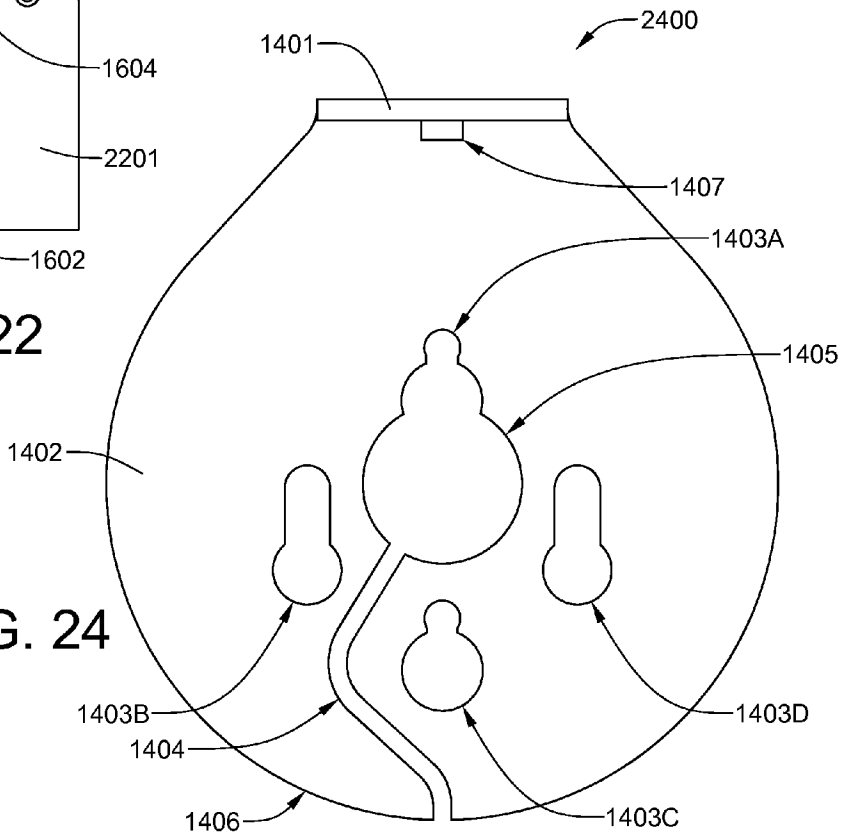
FIG. 24

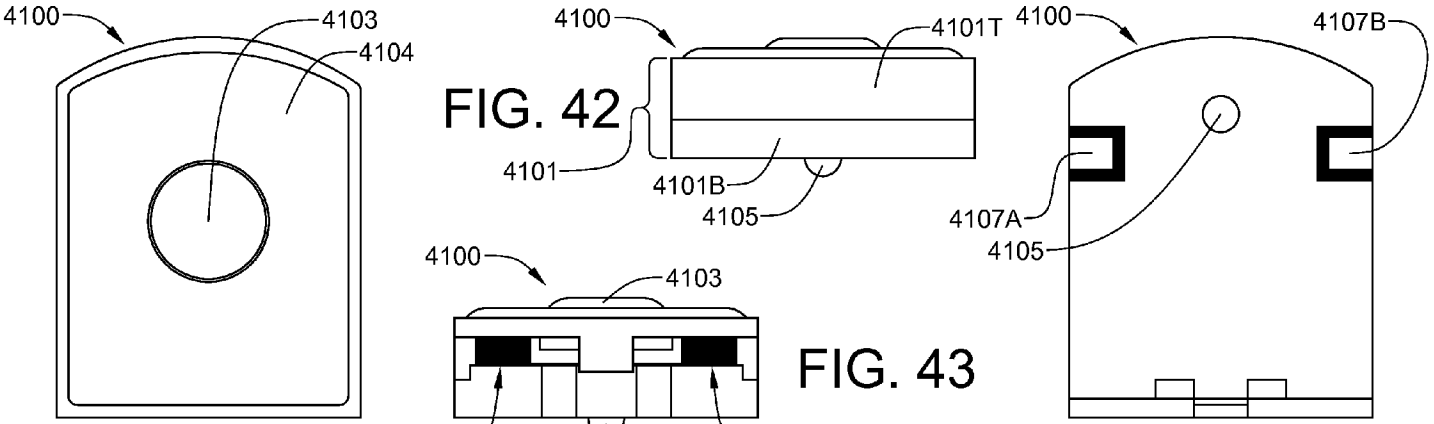
FIG. 41
FIG. 42
FIG. 43
FIG. 44
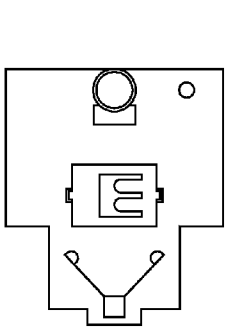
FIG. 47
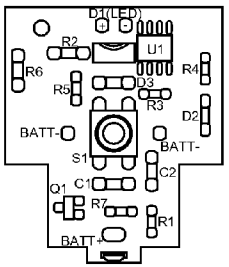
FIG. 48
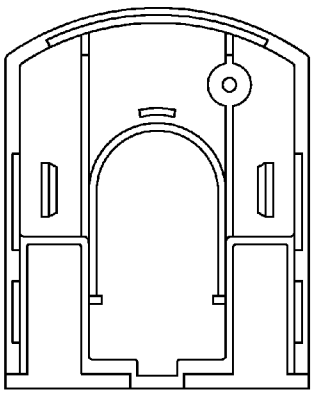
FIG. 46
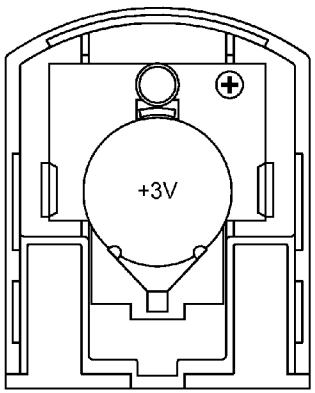
FIG. 45

SECURITY SAFE LIGHT MODULE

This application has a priority date based on the filing, by the same inventors, of Provisional Patent Application No. 61/172,415, of the same title, on Apr. 24, 2009.

BACKGROUND OF THE INVENTION

1. Field of the Invention

This invention relates generally to battery-powered LED light sources and, more specifically, to intermittent battery-powered LED light sources for use on safes having both mechanical and electronic combination locks.

2. Description of the Prior Art

Although consumer spending decelerated rapidly in the United States following the election of Barack Hussein Obama as the country's 38$^{th}$ President, firearms and gun safes were not only immune from the consumer spending meltdown, but their sales increased exponentially. The dramatic increase in sales of firearms had little to do with sales of hunting rifles and shotguns. Rather, it was largely attributable to increased sales of assault rifles and handguns.

Gun safes are routinely used to safeguard firearms against theft by burglars, as well as to prevent unauthorized access to firearms by minors and others who are unauthorized to use them. Gun safes are typically equipped with either a mechanical or electronic combination lock, which unlocks a front access door when the proper combination is entered. Were a gun-possessing home owner to detect entry of a burglar into his home at nighttime, that home owner would want to be able to open his gun safe without detection and remove an appropriate weapon with which to confront the intruder. Whereas conventional internal home lighting systems could give the owner away while attempting to open the safe, a low-power light that illuminates only the safe's combination lock would make it far more likely that the home owner could open his gun safe undetected. Although a flashlight might accomplish the task, flashlights suffer from a number of significant drawbacks. First, the beam of a flashlight might be far brighter than required for the task and might give away the presence of the awakened homeowner. Second, as the beam of the flashlight is not automatically directed at the combination lock, it may be difficult to hold the flashlight while operating the combination lock. Third, a flashlight must have power cells with sufficient charge to light the filament of the flashlight's lightbulb. As most flashlights lack momentary-on switches, it is not uncommon to inadvertently leave a flashlight switch in the "ON" position and run down the charge of the power cells to zero. Fourth, the home owner must know where the flashlight can be found without turning on interior house lights. Flashlights are frequently misplaced by household occupants.

What is needed is a dedicated, low-power light module for illuminating, on demand, the combination lock of security safes and, particularly, of gun safes.

SUMMARY OF THE INVENTION

The present invention fulfills the need for a dedicated, low-power light module for illuminating, on demand, the combination lock of security safes and, particularly, the combination lock of a security safe designed to store firearms. Five embodiments of the invention are disclosed herein. The first, third and fourth embodiments are designed to magnetically or adhesively adhere to the outer surface of the steel access door of a safe, while the second and fifth embodiments are designed to be permanently sandwiched between the outer surface of the access door and the combination lock which is secured to the door's outer surface with screws accessible from the inside of the safe. All embodiments include a housing preferably made of polymeric structural resin, a 3-volt lithium coin cell, a light emitting diode, and a switch. While the first and second embodiments have a switch that requires the continued application of pressure for the LED to remain illuminated, the third, fourth and fifth embodiments have a timing circuit that turns on the LED once the switch is activated and automatically turns off power to the LED after a set period of time has elapsed.

The first embodiment of the invention, is constructed of multiple layers assembled in the following order: a magnetic layer to which an adhesive coating is applied to one side thereof, a backing member having inner and outer major surfaces, a chamber member; a clear acrylic coin cell and LED holder which installs within the chamber member and also serves as a light guide, an LED installed within the LED holder, and a single-stick membrane layer. The magnetic layer is adhered to the outer major surface of the backing member, the chamber member is secured to the backing member with self-tapping screws, and the membrane layer is adhesive secured to the chamber member, with the coin cell, LED holder and LED enclosed within the chamber. The LED leads are configured (i.e., bent) to provide a normally-off electrical circuit, with the negative LED lead in constant contact with the negative terminal of the coin cell. When the membrane layer is pressed, the positive LED leads makes contact with the positive terminal of the coin cell, thereby completing the electrical circuit and illuminating the LED.

The second embodiment of the invention is similar to the first embodiment, with the following exceptions. A focusing lens installed in the backing member takes the place of the light guide of the first embodiment. The coin cell chamber member is unitary with a base plate that is designed to be sandwiched between an outer surface of the safe access door and a combination lock installed thereon. As combination locks are generally of a standard size, the backing member of the second embodiment light module is sized so that it is coextensive with the mounting region of the combination lock. The base plate is equipped with a central aperture, a slit leading from the central aperture In order to the outer edge of the base plate, which enables the base plate to be installed behind an electronic combination lock without disconnecting the wiring that connects the keypad of the combination lock to the mechanical components of the lock. The base plate is also equipped with smaller apertures through which the combination lock securing screws can pass. In order to provide access to both sides of the complete light module, so that it can be disassembled without its removal from beneath the combination lock, the coin cell chamber member is bent at a 90-degree angle from the base plate so that it is perpendicular with the outer surface of the safe access door when the light module is installed. One end of the backing member of the second embodiment light module has a tab that is secured to an aperture located near the bend between the coin cell chamber member and the base plate. The other end of the backing member is secured to the coin cell chamber member with self-tapping screws. Like the first embodiment, the second embodiment also includes an LED holder which installs within the chamber member, an LED installed within the LED holder, and a single-stick membrane layer which is adhered to an outer surface of the coin cell chamber member, with the coin cell, LED holder and LED enclosed within the chamber. The LED holder of the second embodiment lacks a light guide, as its function is replaced by the focusing lens installed in the backing member. As with the first embodiment light module, the LED leads are configured to provide a normally-off electrical circuit, with the negative LED lead in constant contact with the negative terminal of the coin cell. When the membrane layer is pressed, the positive LED leads makes contact with the positive terminal of the coin cell, thereby completing the electrical circuit and illuminating the LED.

The third and fourth embodiments of the invention are functionally similar. Both have circuits which maintain power to the LED once the switch is activated, and both have timing circuits that cut off power to the LED after a set period of time has elapsed. The primary difference is that the third embodiment is designed for security safes having mechanical combination locks. The fourth embodiment, on the other hand, is designed for security safes having electronic combination locks. On the latter the electronic keypad projects much further from the surface of the safe door. As a consequence, the LED on the fourth embodiment must be positioned further away from the door's exterior surface so that it can illuminate the keypad.

The fifth embodiment of the invention is similar to the second embodiment, but with the circuitry of the third and fourth embodiments. A backing plate is sandwiched between the electronic keypad and the exterior surface of the safe door. The module slides on to a pair of spaced-apart module mounting prongs on the backing plate. The module is easily removed in order to replace the 3-volt lithium cell when it is expended.

BRIEF DESCRIPTION OF THE DRAWINGS

FIGS. 1 to 13 show a first embodiment security safe light module and components thereof in various stages of assembly, while FIGS. 14 to 23 show a second embodiment security safe light module.

FIG. 1 is a top plan view of an adhesive-baked laminar magnetic layer;

FIG. 2 is a plan view of the outer surface of the backing member, showing four countersunk screw holes thereon;

FIG. 3 is a plan view of either side of the chamber member;

FIG. 4 is a plan view of an adhesive-backed, flexible membrane layer having a circular film member adhered thereto;

FIG. 5 is a top plan view of the coin cell and LED holder, which also serves as a light guide;

FIG. 6 is a plan view of an assembly consisting of the coin cell and LED holder bonded to the inner surface of the backing member;

FIG. 7 is a side elevational view of the assembly of FIG. 6;

FIG. 8 is a plan view of the plus terminal of CR2016 coin cell;

FIG. 9 is an elevational view of a light emitting diode having its anode lead upwardly bent;

FIG. 10 is a plan view of the assembly of FIG. 6, loaded with the CR2016 coin cell and the LED, with the anode lead shown;

FIG. 11 is an elevational view of the loaded assembly of FIG. 10;

FIG. 12 is an exploded view of the various components prior to assembly;

FIG. 13 is an elevational view of the assembled first embodiment;

FIG. 14 is an elevational view of a unitized base plate and coin cell chamber member before the latter is bent forward on a 90-degree angle;

FIG. 15 is a plan view of the coin cell and LED holder;

FIG. 16 is plan view of the inner surface of the backing member;

FIG. 17 is an elevational left-side view of the backing member

FIG. 18 is a plan view of a coin cell;

FIG. 19 is a plan view of an assembly consisting of the coin cell and LED holder bonded to the inner surface of the backing member;

FIG. 20 is an elevational view of a light emitting diode (LED);

FIG. 21 is a plan view of an assembly consisting of the coin cell and LED holder bonded to the inner surface of the backing member after an LED and a coin cell have been loaded therein;

FIG. 22 is a plan view of the outer surface of the assembly of FIG. 21;

FIG. 23 is a plan view of an adhesive-backed, flexible membrane layer that will adhere to the coin cell chamber member;

FIG. 24 is an elevational view of a unitized base plate and coin cell chamber member after the latter is bent forward on a 90-degree angle;

FIG. 41 is a top plan view of the fifth embodiment security safe light module for safes with an electronic combination lock;

FIG. 42 is a front elevational view of the fifth embodiment security safe light module of FIG. 41;

FIG. 43 is a rear elevational view of the fifth embodiment security safe light module of FIG. 41;

FIG. 44 is a is a bottom plan view of the fifth embodiment security safe light module of FIG. 41;

FIG. 45 is a bottom plan view of the fifth embodiment security safe light module of FIG. 41, following removal of the bottom panel;

FIG. 46 is a bottom plan view of the top panel of the fifth embodiment security safe light module of FIG. 41, following removal of the populated printed circuit board and the attached 3-volt battery;

FIG. 47 is a bottom plan view of the populated printed circuit board of the fifth embodiment security safe light module of FIG. 41, following removal of the 3-volt battery;

FIG. 48 is a is a top plan view of the populated printed circuit board of the fifth embodiment security safe light module of FIG. 41;

PREFERRED EMBODIMENT OF THE INVENTION

Two embodiments of the security safe light module will now be described in detail with reference to the attached drawing FIGS. 1 to 52. Though it should be understood that the drawings are intended to be only illustrative, an attempt has been made to provide drawings which are drawn to scale.

Figures 1, 2:
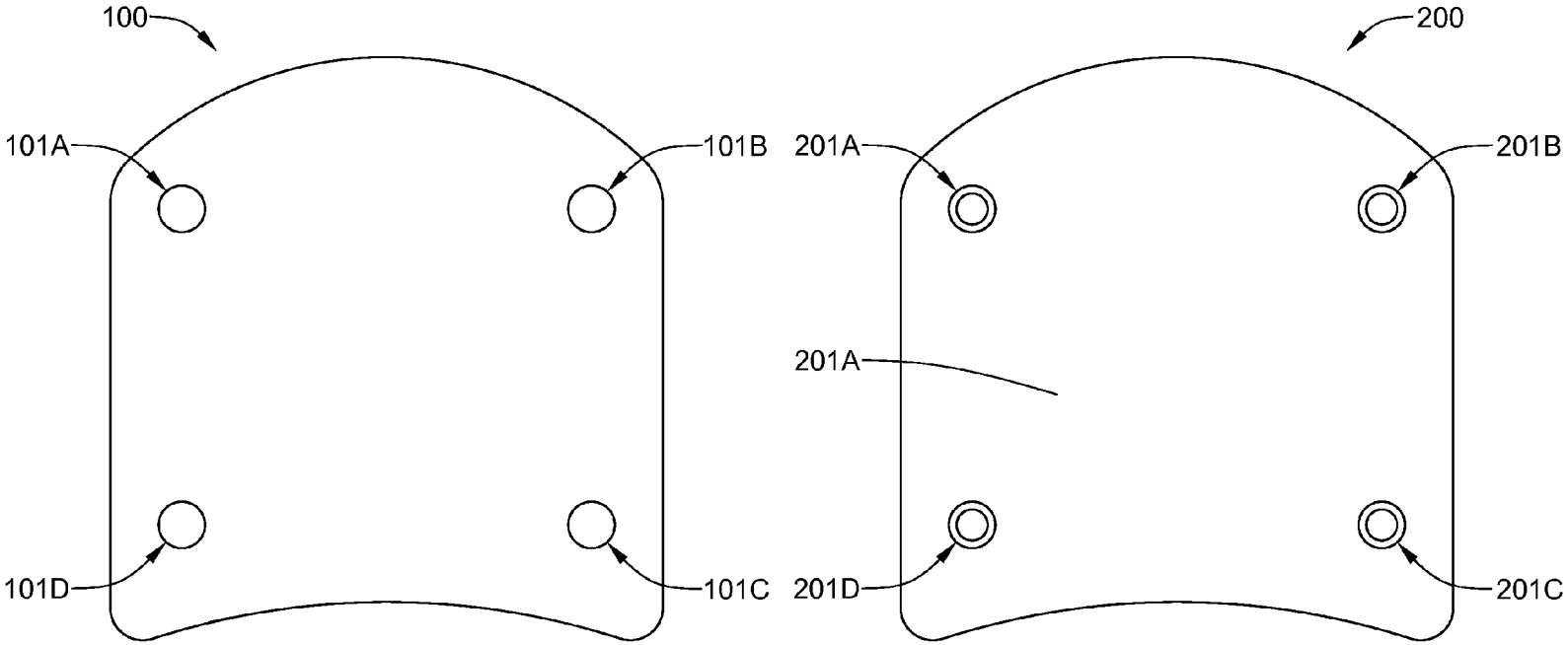

Referring now to FIG. 1, an adhesive-backed laminar magnetic layer 100 adheres to the outer surface of the backing member 200 (see FIG. 2). It will be noted that the adhesive-backed laminar magnetic layer 100 is equipped with four apertures 101A, 101B, 101C and 101D, so that the self-tapping screws (see FIG. 12) that engage the countersunk holes 201A, 201B, 201C and 201D of the backing member 200 (again, see FIG. 2) can be installed and removed without removing the magnetic layer 100.

Referring now to FIG. 2, the backing member 200 is formed from planar, laminar polymeric plastic having a thickness of about 3 millimeters. The backing member is equipped with four holes 201A, 201B, 201C and 201D through which self-tapping screws 1201A, 1201B, 1201C and 1201D are inserted. On the outer major surface 202 of the backing member 200, the four holes 201A, 201B, 201C and 201D have countersunk recesses to receive the heads of the self-tapping screws. The self-tapping screws 1201A, 1201B, 1201C and 1201D secure the backing member to the chamber member 300 (see FIG. 3).

Figure 3:
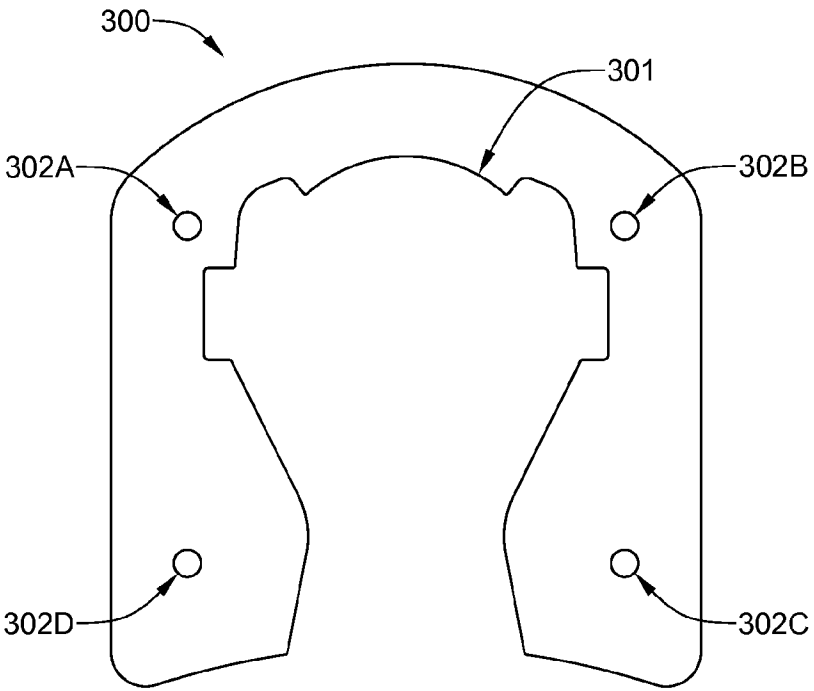
Figure 5:
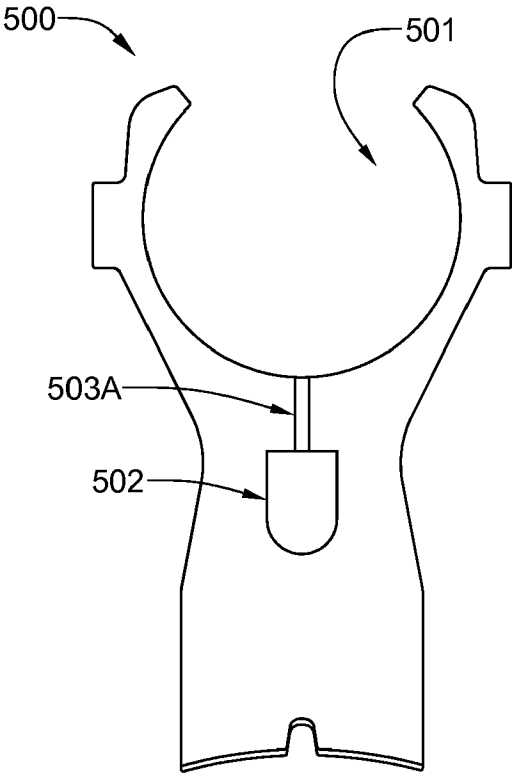

Referring now to FIG. 3, the chamber member 300 has a recess, or chamber, 301 that is sized to receive the coin cell and LED holder 500 of FIG. 5. The chamber member 300 also has four apertures 302A, 302B, 302C and 302D through which assembly screws pass. For a preferred embodiment of the invention, the backing member 200, the chamber member 300, and the coin cell and LED holder 500 are fabricated from laminar polymer plastic having a thickness of about 3 millimeters. The coin cell and LED holder 500 is also fabricated from laminar polymer plastic. However, as it is used as a light guide, it is fabricated from a transparent polymer plastic, such as acrylic.

Figure 4:
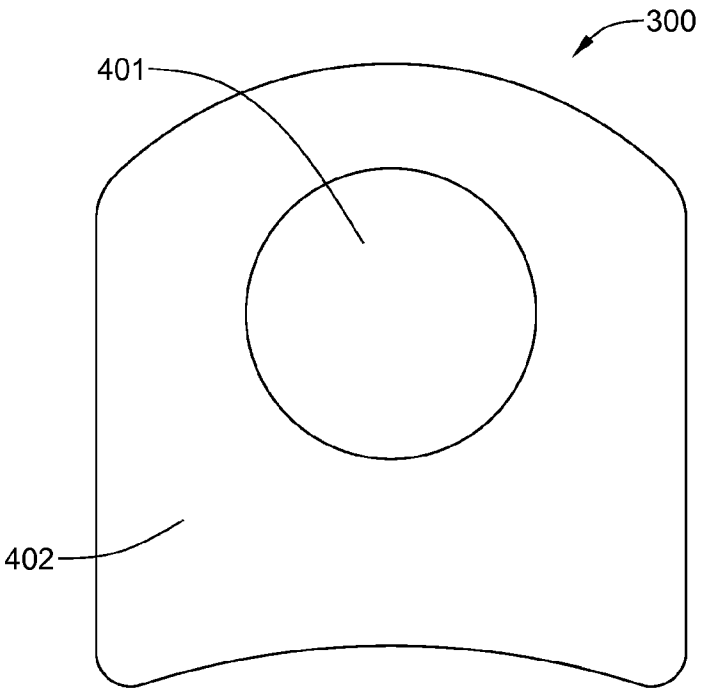

Referring now to FIG. 4, an adhesive-backed, flexible membrane layer 400 is sized to adhere to an outer surface of the chamber member 300. It will be noted that a circular film member 401 covers a portion of the adhesive backing 402 so that the adhesive will not adhere to the coin cell 800.

Referring now to FIG. 5, the coin cell and LED holder 500 is sized to fit within the recess 301 of the chamber member 300. The coin cell and LED holder 500 is equipped with a first cutout 501 for a coin cell, a second cutout 502 into which the plastic head of an LED will fit. It will be noted that each side of the coin cell and LED holder 500 is equipped with a groove 503A and 503B for one of the leads of the LED (only groove 503A is visible in this view).

Figure 7:
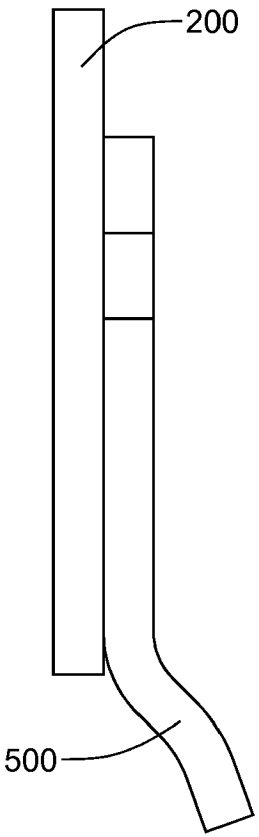
Figure 6:
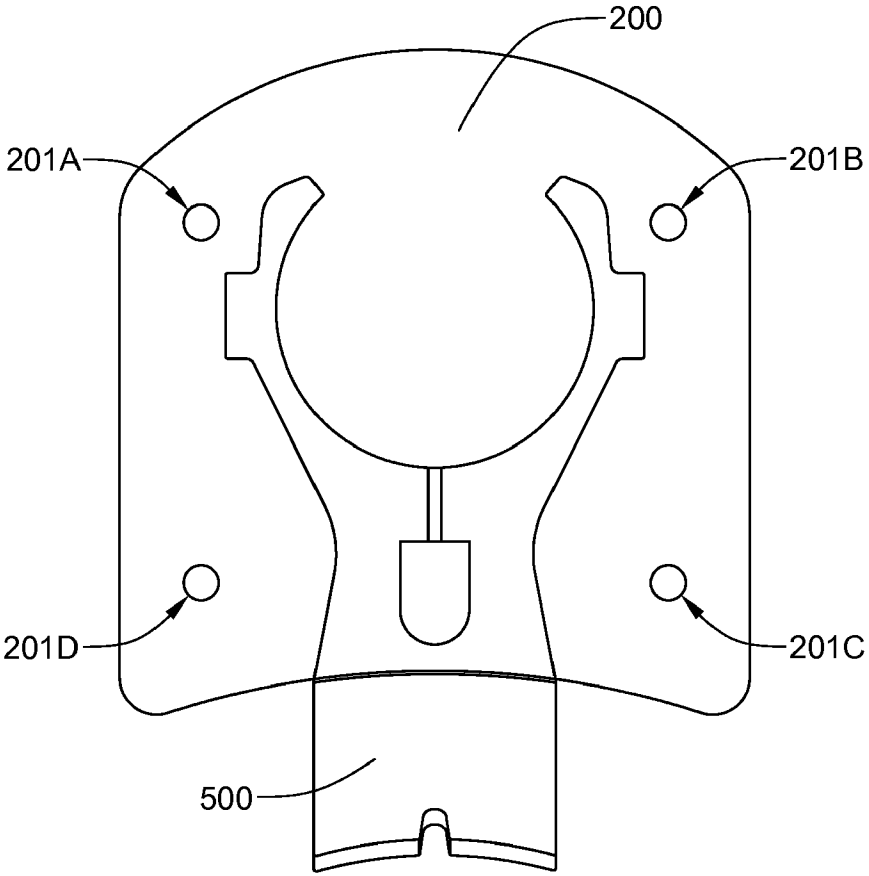

Referring now to FIG. 6, an assembly 600 has been created by bonding one major surface of the coin cell and LED holder 500 to the inner surface 601 of the backing member 200. A side view of this assembly can be seen in FIG. 7.

Figure 8:
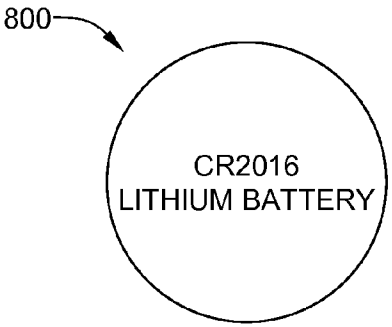

Referring now to FIG. 8, the positive terminal of a CR2016 coin cell 800 is visible.

Figure 9:
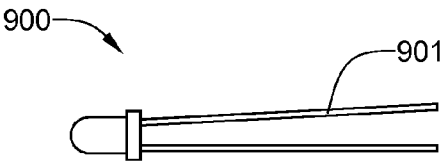

Referring now to FIG. 9, a light emitting diode 900 having its resilient anode lead 901 upwardly bent several degrees is shown.

Figure 11:
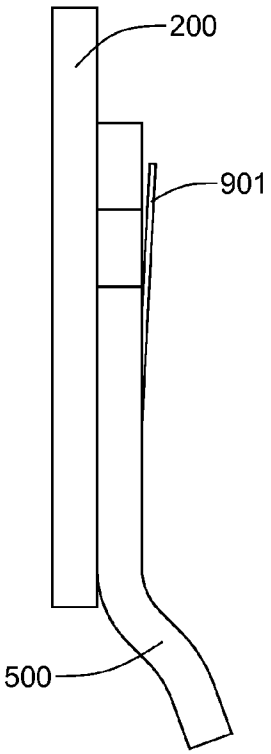
Figure 10:
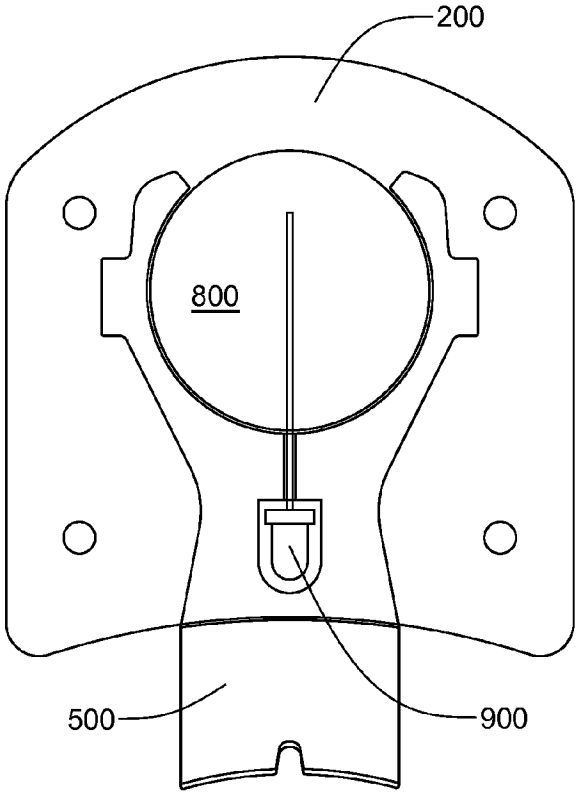

Referring now to FIG. 10, the assembly of FIG. 6 is shown loaded with the CR2016 coin cell 800 and the LED 900. In this view, only the anode lead 901 of the LED 900 is visible. A side view of this loaded assembly is shown in FIG. 11.

Figure 12:
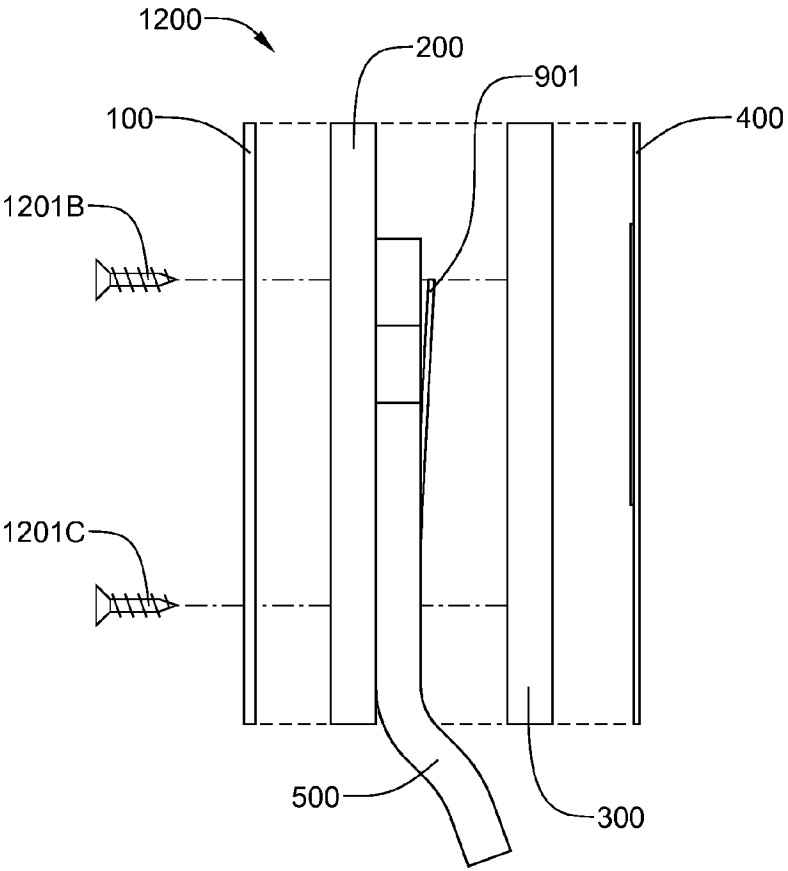

Referring now to FIG. 12, the first embodiment of the security safe light 1200 is shown in exploded form prior to assembly. It will be noted that the assembly will be held together by four self-tapping screws 1201A, 1201B, 1201C and 1201D, only two of which (1201B and 1201C) are visible in this view. It should be obvious that the light can be turned on by pressing on the membrane layer 400 and touching the anode lead 901 to the anode of the coin cell 800.

Figure 13:
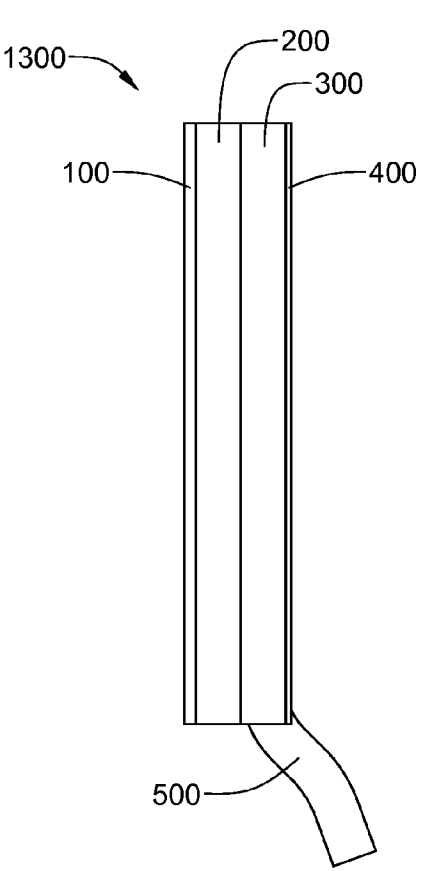

Referring now to FIG. 13, a completely assembled first embodiment security safe light 1300 is shown, with the magnetic layer 100 having the leftmost position, the membrane layer 400 having the rightmost position, the coin cell and LED holder 500 protruding from the chamber member 300, and the backing member sandwiched between the chamber member 300 and the magnetic layer 100. For a presently-preferred version of the first embodiment security safe light 1200, the backing member 200 and chamber member 300 each have a width of about 38 millimeters. An attempt has been made to provide drawings which are close to scale.

Figures 14, 15, 16, 17, 18, 19, 20:
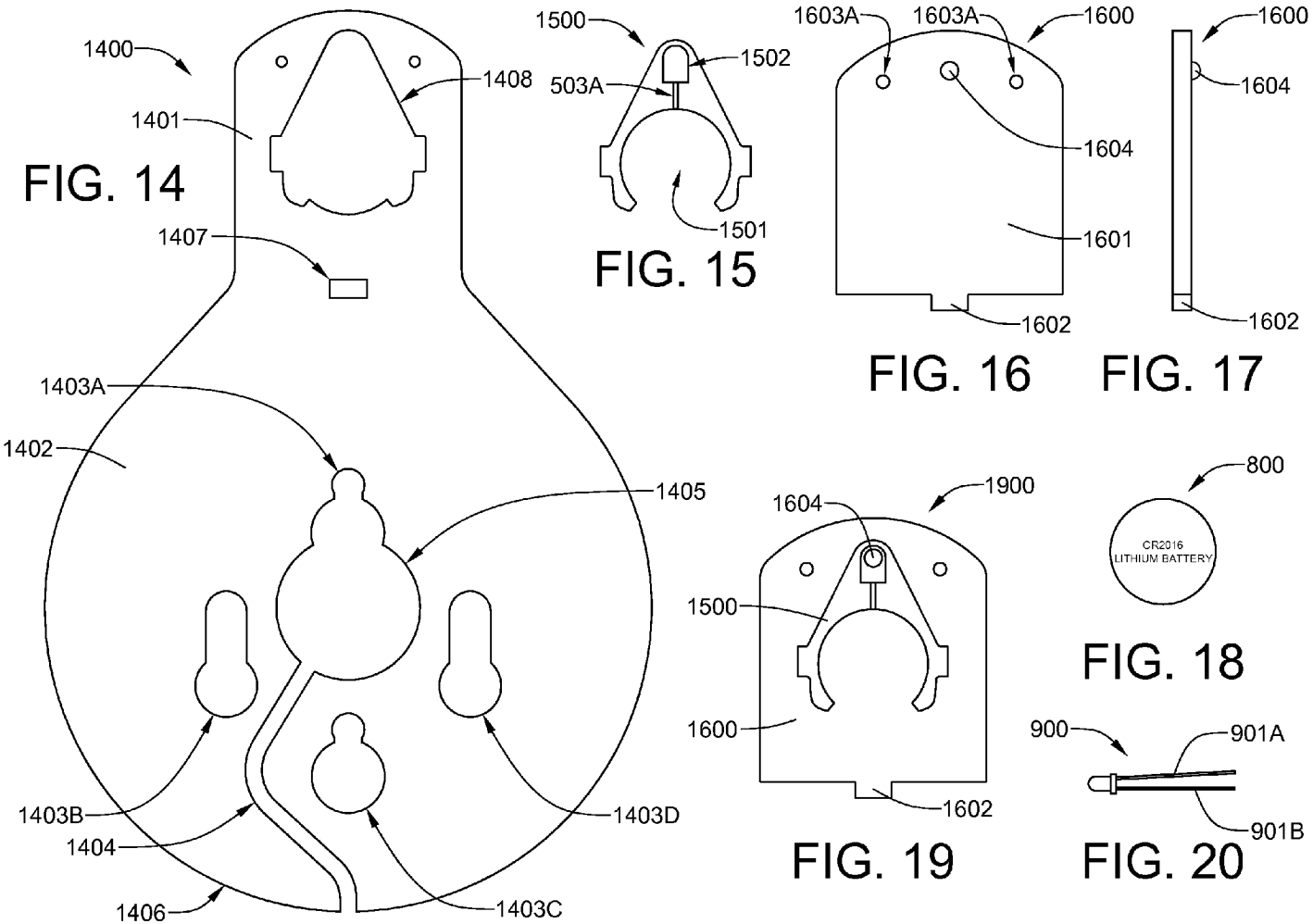

Referring now to FIG. 14, the unitized base plate and coin cell chamber member 1400 of the second embodiment security safe light is shown before the before the coin cell chamber member portion 1401 is bent forward from the base plate portion 1402. It will be noted that the base plate portion 1402 is equipped with a plurality of fastener apertures 1403A, 1403B, 1403C and 1403D that are positioned to accommodate the screw fastener patterns of most combination locks used on gun safes. In addition, a channel 1404 connecting a center cutout 1405 with the periphery 1406 allows the base plate to be installed by merely loosening the locks securing screws and sliding it over the cable that connects the lock opening mechanism to the external lock keypad. A rectangular aperture 1407 below the cell chamber 1408 will receive the rectangular tab that projects from the rear edge of the backing member 1600.

Referring now to FIG. 15, the coin cell and LED holder 1500 has a cutout 1501 for a coin cell, a cutout 1502 for the plastic head of an LED. Each side of the coin cell and LED holder 1500 is equipped with a groove 1503A and 1503B for one of the LED leads. Only groove 1503 is seen in this view.

The coin cell and LED holder 1500 differs from that of the first embodiment unit 500, in that it need not be transparent as it is not used as a light guide.

Referring now to FIG. 16, the inner surface of the backing member 1600 is seen in this view. It will be noted that a rectangular tab 1601 projects from the rear edge of the backing member 1600. In addition, there is a transparent light diffusing lens 1602 that is installed in an aperture of the backing member 1600. In addition, a pair of screw holes 1603A and 1603B will engage screws that are used to secure the backing member 1600 to the chamber member portion 1401. The backing member 1600 can be seen in a side view in FIG. 17.

Referring now to FIG. 18, the annode surface is seen in this view of a CR2016 coin cell 800. Although this is a common and readily available type of coin cell, other types of coin cells can be substituted therefor.

Referring now to FIG. 19, a an assembly 1900 has been created by bonding a major surface of the coin cell and LED holder 1500 to the inner surface 1901 of the backing member 1600.

Referring now to FIG. 20, a typical light emitting diode (LED) 900 is shown. It will be noted that its resilient anode lead 901 has been upwardly bent several degrees. This prevents the lead from making continuous contact with the anode of the coin cell 800.

Referring now to FIG. 21, a coin cell 800 and an LED 900 have been loaded into the assembly 1900 of FIG. 19. It will be noted that the light-emitting portion of the LED 900 is positioned directly above the light diffusing lens 1602.

Referring now to FIG. 22, the outer surface 2201 of the backing member 1600 is shown. It will be noted that the screw holes 1603A and 1603B have countersunk recesses 2202A and 2202B on this side of the backing member 1600.

Referring now to FIG. 23 is a plan view of an adhesive-backed, flexible membrane layer 2300 that will adhere to the coin cell chamber member portion 1401. It will also be noted that a circular film member 2301 covers a portion of the adhesive backing 2302 so that the adhesive will not adhere to the coin cell 800.

Referring now to FIG. 24, the unitized base plate and coin cell chamber member 1400 is shown after the chamber member portion 1401 is bent forward on a 90-degree angle from the base plate portion 1402, resulting in a final configuration base plate and coin cell chamber member 2400.

Figures 25, 26, 27:
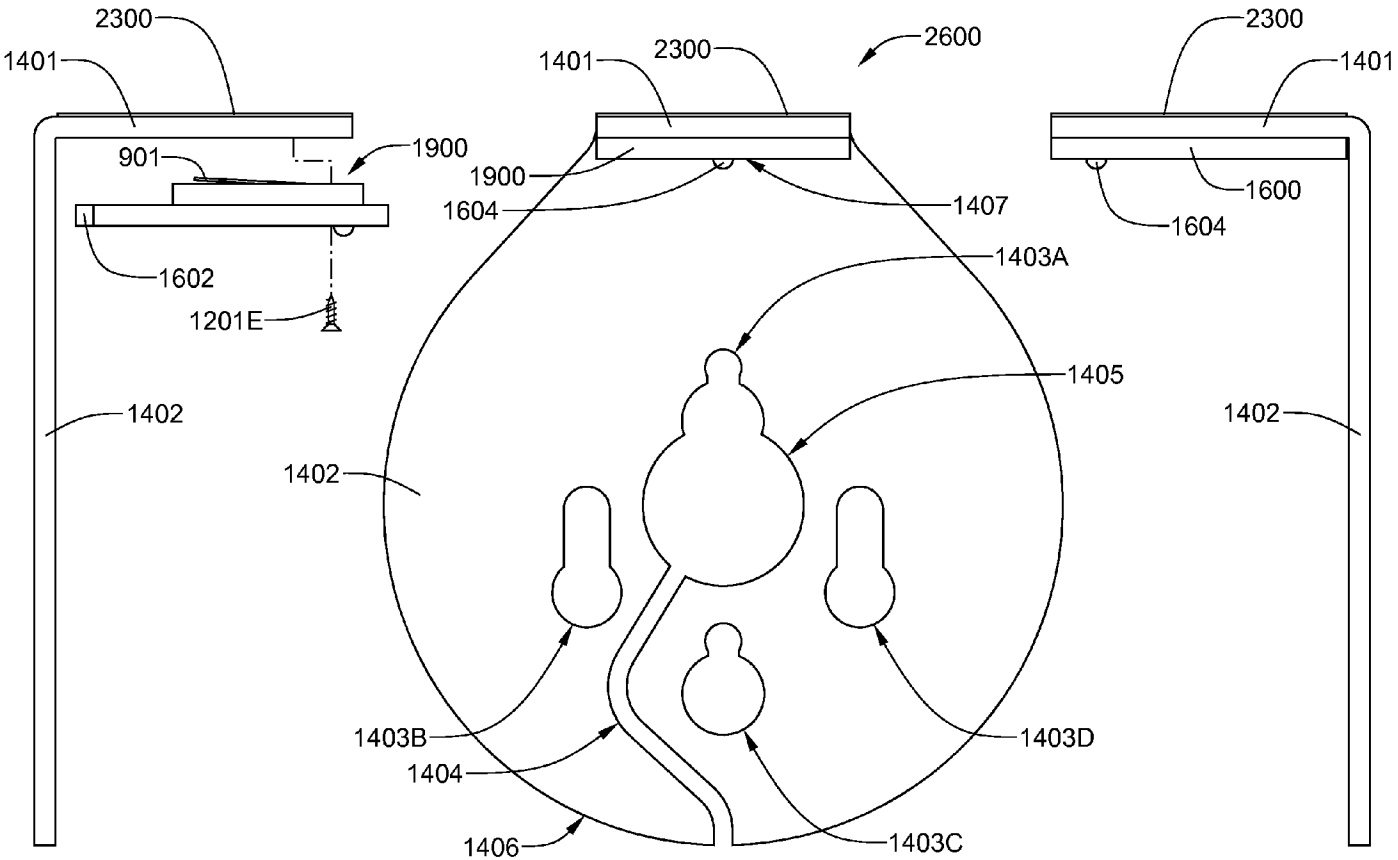
FIG. 25 is an exploded left-side elevational view of the second embodiment security safe light module prior to assembly.
FIG. 26 is a an elevational view of the assembled second embodiment security safe light module, showing the unitized base plate and coin cell chamber member after the latter has been bent forward on a 90-degree angle, showing the backing member secured to the coin cell chamber member and the flexible membrane member adhered to an upper surface of the coin cell chamber member.
FIG. 27 is a right-side elevational view of the assembled second embodiment security safe light module.
Figure 30:
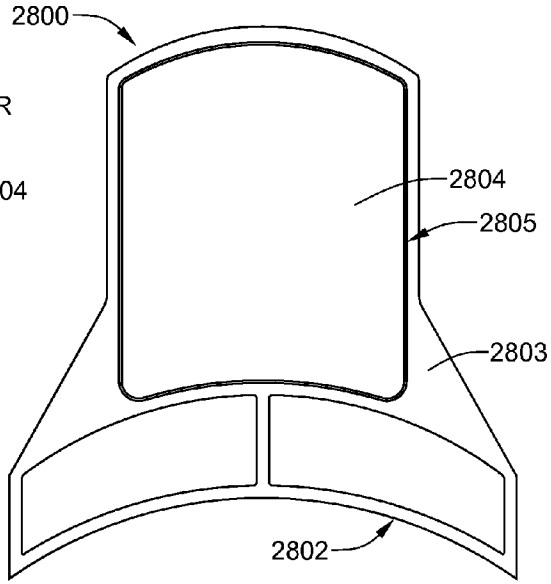
FIG. 30 is a rear elevational view of the third embodiment security safe light module of FIG. 28.
Figure 32:
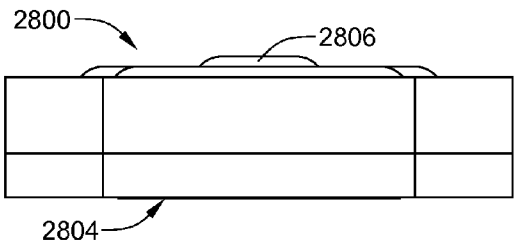
FIG. 32 is a top plan view of the third embodiment security safe light module of FIG. 28.
Figure 29:
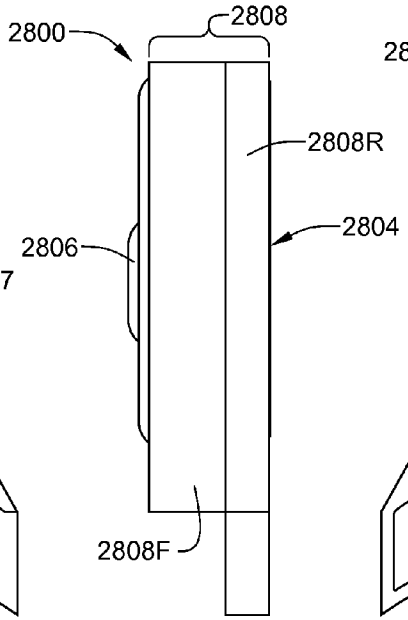
FIG. 29 is a right-side elevational view of the third embodiment security safe light module of FIG. 28.
Figure 28:
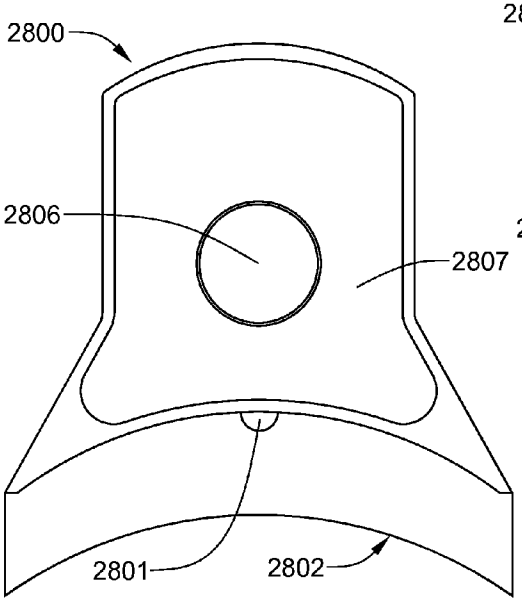
FIG. 28 is a front elevational view of a magnetically-adhering third embodiment security safe light module for safes with a mechanical combination lock, the safe light module having a normally-open switch for manually coupling an LED to a electrochemical power source and circuitry for automatically decoupling the LED from the power source after a set period of time.
Figure 31:
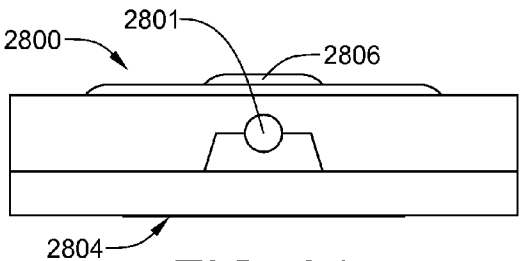
FIG. 31 is a bottom plan view of the third embodiment security safe light module of FIG. 28.
Figure 33:
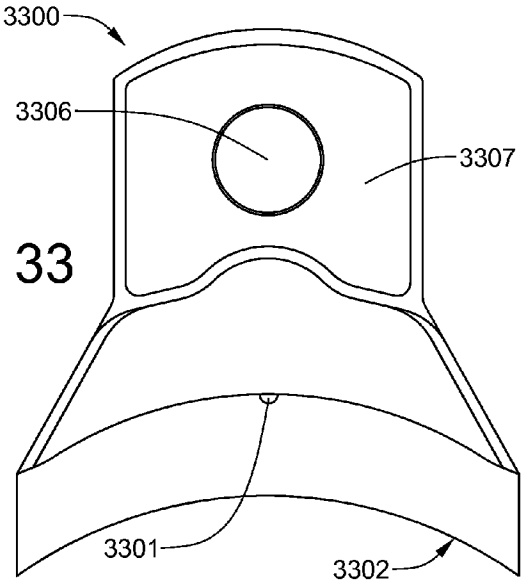
FIG. 33 is a is a front elevational view of a magnetically-adhering fourth embodiment security safe light module for safes with an electronic combination lock, the safe light module having a normally-open switch for manually coupling an LED to a electrochemical power source and circuitry for automatically decoupling the LED from the power source after a set period of time.
Figure 34:
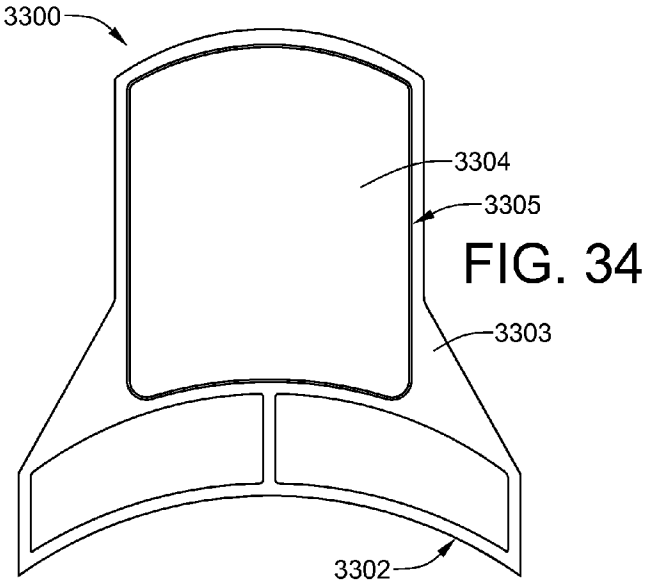
FIG. 34 is a rear elevational view of the fourth embodiment security safe light module of FIG. 33.
Figure 35:
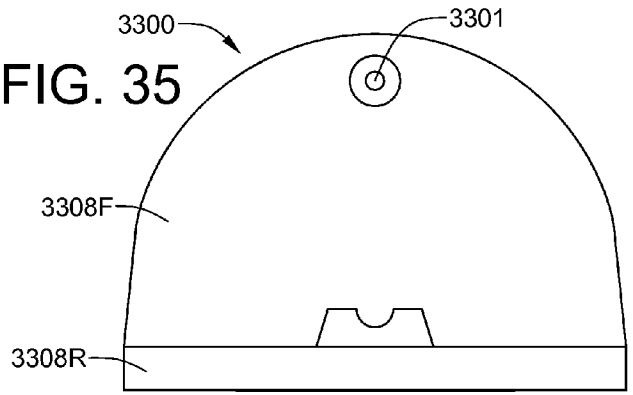
FIG. 35 is a bottom plan view of the fourth embodiment security safe light module of FIG. 33.
Figure 36:
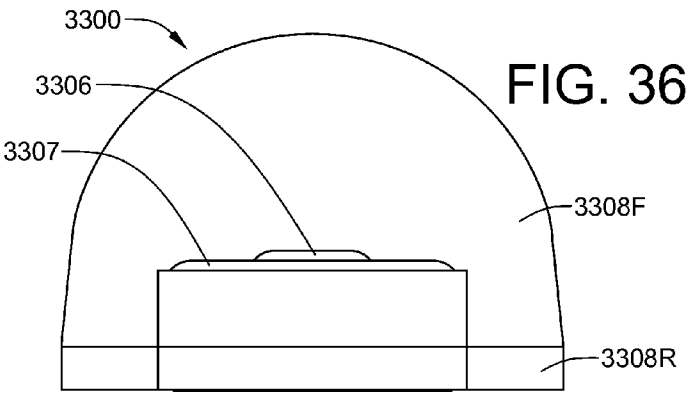
FIG. 36 is a top plan view of the fourth embodiment security safe light module of FIG. 33.

Referring now to FIG. 25, an exploded assembly 2500 of the second embodiment security safe light module 2500 is shown in a left-side view. Notice that a pair of self-tapping screws 1201E and 1201F, only one of which (1201E) is visible in this view. It should be obvious that the light can be turned on by pressing on the membrane layer 2300 and touching the anode lead 901 to the anode of the coin cell 800.

Referring now to FIG. 26, the assembled second embodiment security safe light module 2600 is shown in a front view. The light diffusing lens 1602 can be clearly seen; and Referring now to FIG. 27, the assembled second embodiment security safe light module 2600 is shown in a left-side view. For a presently-preferred version of the second embodiment security safe light module 2500, the base plate portion 1402 has a diameter of about 10.2 cm (4 inches).

The third, fourth and fifth embodiment security safe light modules all use virtually identical electronic circuitry, which provides for the push of a single, momentary contact switch to turn on a single light emitting diode, and a timed off function. A number of different circuits, including those with integrated circuit components, can be used to implement this functionality. The simplest circuit would involve using the momentary contact switch to rapidly charge a capacitor from an electro-chemical power supply. The capacitor is coupled to both the gate of an N-channel field effect transistor and a sink to ground through a resistor. The resistance of the resistor determines the time required to bleed the charge of the capacitor below the threshold voltage of the N-channel field effect transistor, which provides a current path from the electro-chemical power supply to the LED. When the charge on the capacitor drops below the threshold voltage, flow of current to the LED through the transistor channel is shut off.

Referring now to FIGS. 28 through 32, a magnetically-adhering third embodiment security safe light module 2800 is designed primarily for safes having a mechanical combination lock. As mechanical combination locks are typically low profile (i.e., they protrude only about 0.5 mm (about 0.2 inches) from the exterior surface of the safe door, the LED 2801 need be positioned only about 1.0 cm (0.4 inches) from the same surface in order to adequately illuminate the dial of the mechanical combination lock (not shown). The third embodiment security safe light module 2800 has an arcuately-curved lower surface 2802, which closely corresponds to the outside diameter of the dial of the mechanical combination lock. The rear surface 2803 of the third embodiment light module 2800 is equipped with a magnetic pad 2804, which is adhesively bonded within a recess 2805. The magnetic pad 2804 readily adheres to the exterior surface of the safe door. A single button 2806, located approximately in the center of a front trim panel 2807 turns on the LED 2801. It will be noted that the module case 2808 has a rear portion 2808R and a front portion 2808F.

Referring now to FIGS. 33 to 37, a magnetically-adhering fourth embodiment security safe light module 3300 is designed primarily for safes with an electronic combination lock having a key pad that is considerably thicker than the dial of a mechanical combination lock. As the electronic key pad of the electronic combination locks typically protrude up to 3.5 cm (about 1.4 inches) from the exterior surface of the safe door, the LED 3301 needs to be positioned at least 4.0 cm (about 1.6 inches) from the same surface in order to adequately illuminate the electronic keypad (not shown). As the digital keypads of electronic combination locks are also typical manufactured in circular configurations, the fourth embodiment security safe light module 3300 also has an arcuately-curved lower surface 3302, which closely corresponds to the outside diameter of the digital keypad. The rear surface 3303 of the third embodiment light module 3300 is equipped with a magnetic pad 3304, which is adhesively bonded within a recess 3305. The magnetic pad 3304 readily magnetically adheres to the exterior surface of the safe door. A single button 3306, located approximately in the center of a front trim panel 3307, turns on the LED 3301. It will be noted that the rear portion 3308R of the module case 3308 is identical to that of the rear portion 2808R of the third embodiment security safe light module 2800.

Figure 40:
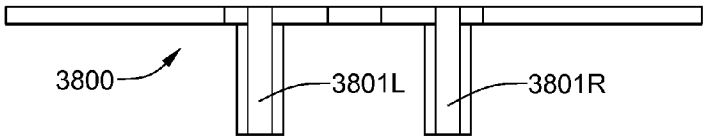
FIG. 40 is a top plan view of the backing plate of FIG. 39.
Figure 39:
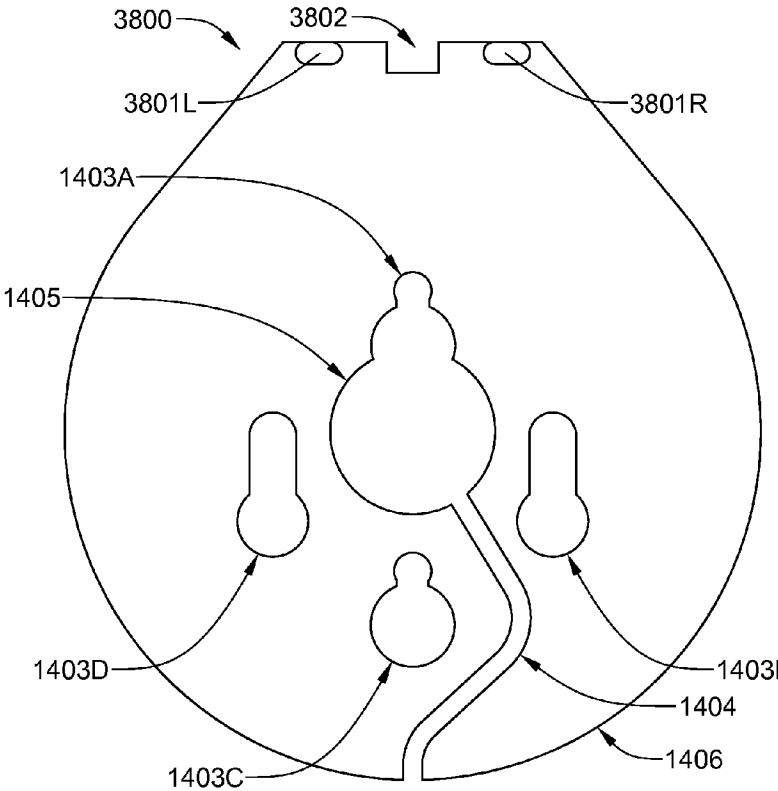
FIG. 39 is a front elevational view of the backing plate of FIG. 38.
Figure 38:
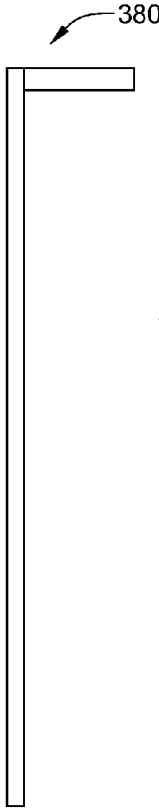
FIG. 38 is a right-side elevational view of a backing plate for a fifth embodiment security safe light module for safes with an electronic combination lock, the safe light module having a normally-open switch for manually coupling an LED to a electrochemical power source and circuitry for automatically decoupling the LED from the power source after a set period of time.
Figure 37:
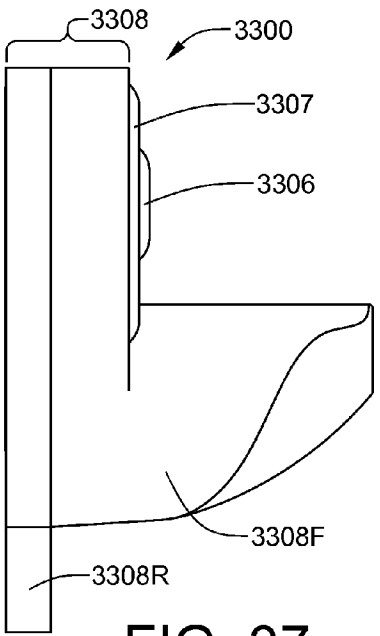
FIG. 37 is a right-side elevational view of the fourth embodiment security safe light module of FIG. 33.

Referring now to FIGS. 38 to 40, a backing plate 3800 for a fifth embodiment security safe light module for safes with an electronic combination lock resembles the base portion 1402 of the unitized base plate and coin cell chamber member 1400 of the second embodiment security safe light. The backing plate 3800, like the base portion 1402, is equipped with a plurality of fastener apertures 1403A, 1403B, 1403C and 1403D that are positioned to accommodate the screw fastener patterns of most combination locks used on gun safes. In addition, a channel 1404 connecting a center cutout 1405 with the periphery 1406 allows the base plate to be installed by merely loosening the locks securing screws and sliding it over the cable that connects the lock opening mechanism to the external lock keypad. The backing plate 3800 for the fifth embodiment security safe light module has left and right horizontal module attachment prongs 3801L and 3801R, respectively, onto which the fifth embodiment security safe light module slides. The notch 3802 in the center of the upper edge 3803 of the backing plate 3800 receives the tab at the rear of the upper portion of the fifth embodiment security safe light module.

Referring now to FIGS. 41 to 44, the fifth embodiment security safe light module 4100 has a module case 4101 with a top portion 4101T and a bottom portion 4101B. On the upper surface 4102 of the top portion 4101T, there is an ON button 4103 located approximately in the center of a trim panel 4104. The ON button turns on power from an electro-chemical source to the light-emitting diode 4105. Circuitry internal to the module 4100 shuts off the flow of electrical power after a set period of time. At the rear of the fifth embodiment module 4100 are a pair of spaced-apart cavities 4106R and 4106L of rectangular cross section which engage the horizontal module attachment prongs 3802L and 3802R at the top of backing plate 3800. On the lower surface of the bottom portion 4101B, there are a pair of squeeze-together tabs 4107A and 4107B that release the bottom portion 4101B from the top portion 4101T, thereby enabling the bottom portion 4104B to swing down and disconnect from the top portion 4101T. With the bottom portion 4101B removed, the electro-chemical power supply (see FIG. 45) contained within the fifth embodiment module 4100 can be replaced when expended.

Referring now to FIG. 45, the bottom portion 4101B has been removed to expose the internal components of the fifth embodiment module 4100. A circuit board 4501 is secured to the top portion 4101T with a pair of clips 4502L and 4502R and a self-tapping screw 4503. A 3-volt battery 4504 provides power for the LED 4105 and for the timing circuitry (visible on the top side of the circuit board 4501 in FIG. 48), which are soldered to the circuit board 4501. Each of the cavities 4106R and 4106L is visible in this view. It will be noted that a spring-loaded positive contact 4505 engages the periphery of the 3-volt battery 4504.

Referring now to FIG. 46, the printed circuit board 4501, along with the 3-volt battery 4505 have been removed from the top portion 4101T of the fifth embodiment module case 4101. The aperture 4601, which receives the threaded portion of the self-tapping screw 4503, can be seen in this view.

Referring now to FIG. 47, the 3-volt battery 4505 has been removed from the printed circuit board 4501 in order to show the spring-loaded negative contact 4701 which presses against the lower surface (negative terminal) of the 3-volt battery 4505. The aperture 4702, through which the self-tapping screw 4503 is inserted, is also visible in this view.

Referring now to FIG. 48, the device-populated upper surface 4801 of printed circuit board 4501 is visible in this view. The circuits components include seven resistors (R1-R7), a pair of capacitors (C1-C2), two diodes (the LED 4105 and D2), an integrated circuit package U1, a single N-channel field effect transistor Q1, a momentary contact switch S1, and of course, the 3-volt battery 4505.

Figure 50:
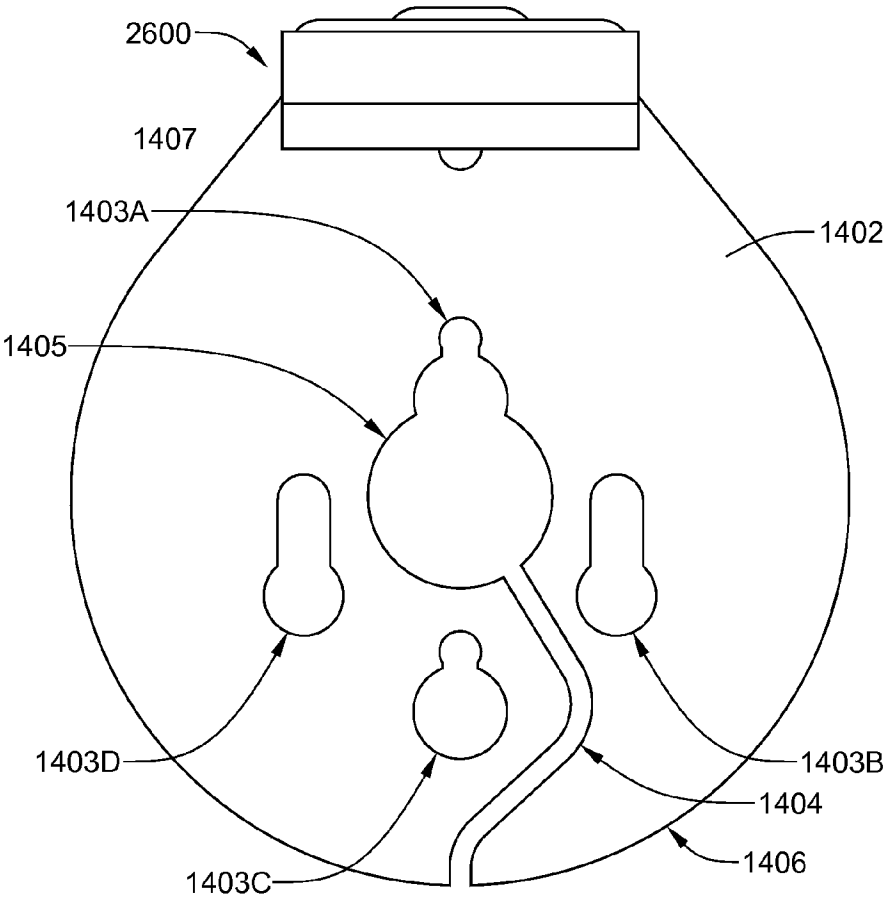
FIG. 50 is a front elevational view of the backing plate of FIG. 38 with the fifth embodiment security safe light module installed thereon.
Figure 49:
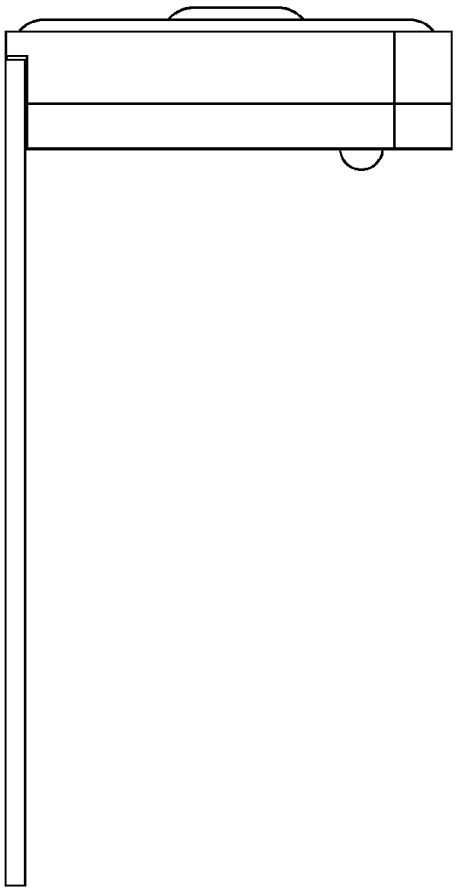
FIG. 49 is a side elevational view of the backing plate of FIG. 38 with the fifth embodiment security safe light module installed thereon.

Referring now to FIGS. 49 and 50, a fifth embodiment security safe light module 4100 has been installed on the backing plate 3800, resulting in a complete fifth embodiment module assembly 4900.

Figure 51:
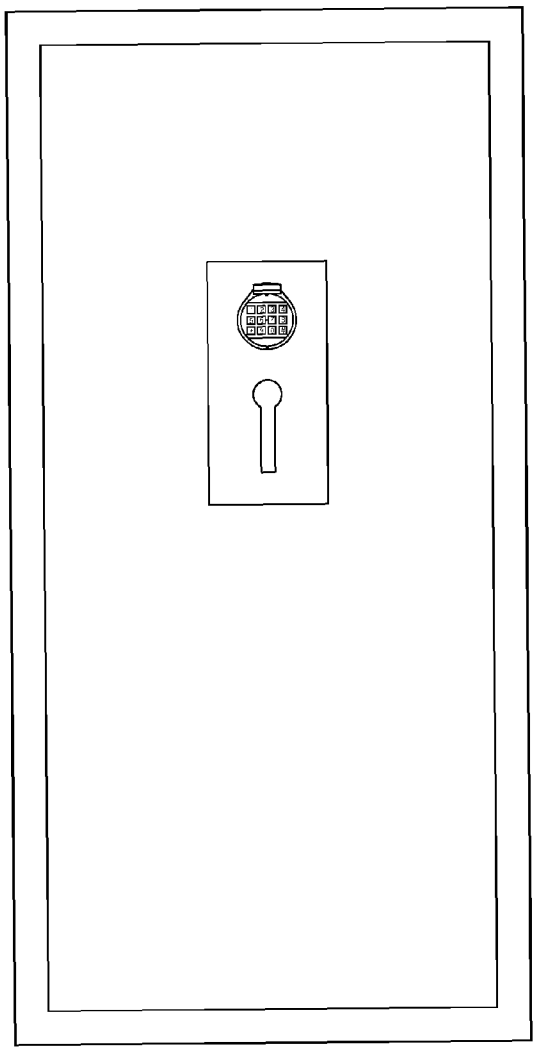
FIG. 51 is a front elevational view of a fifth embodiment safe light module installed on a security safe having an electronic lock incorporated into the door thereof.

Referring now to FIG. 51, the fifth embodiment module assembly 4900 has been installed on a security safe 5100, with the backing plate 3800 sandwiched between the electronic combination lock key pad 5101 and the exterior surface 5102 of the security safe door 5103. The security safe door handle 5104 is located beneath the key pad 5101 and fifth embodiment module assembly 4900.

Figure 52:
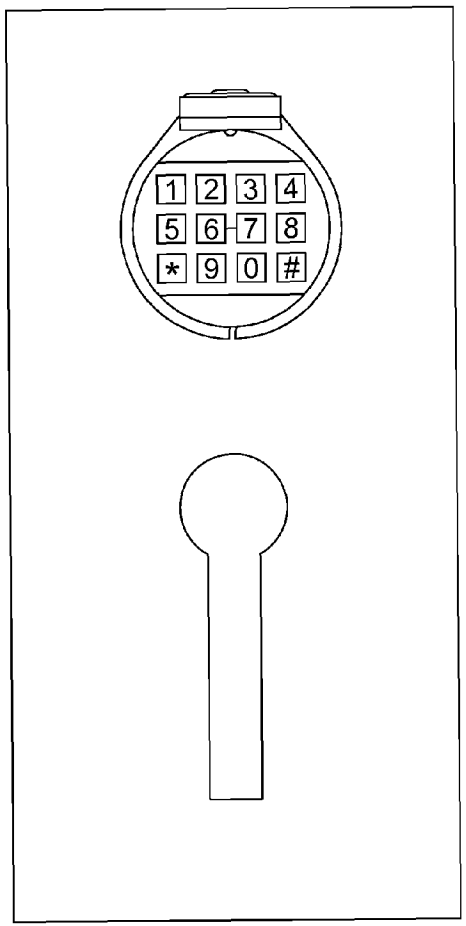
FIG. 52 is a close-up view of the fifth embodiment safe light module, the electronic lock keypad and the handle of the safe of FIG. 51.

Referring now to FIG. 52, a close up view is shown of the fifth embodiment module assembly 4900, the electronic combination lock keypad 5101, and the handle 5104 of the safe of FIG. 51.

Although only five embodiments of the security safe light module have been shown and described herein, it will be obvious to those having ordinary skill in the art that changes and modifications may be made thereto without departing from the scope and the spirit of the invention. For example, the magnetic pad of the embodiments which are designed to magnetically adhere to a safe may be replaced with a double-stick adhesive pad for more permanent attachment of the light modules.

What is claimed is:

1. A light module for a security safe comprising:

a generally circular laminar base plate sandwichable between an electronic combination lock keypad and an exterior surface of a security safe door, said base plate having a central aperture and a slit which begins at the central aperture and terminates at an outer peripheral edge of said base plate, said slit enabling said base plate to be installed behind a keypad without disconnecting wiring connecting a keypad to combination lock mechanical components, said base plate also having a plurality of apertures for a pass through of combination lock keypad securing screws;

a laminar coin cell chamber member portion unitary with said laminar base plate, said coin cell chamber forming an angle of about 90 degrees with said laminar base plate;

a backing member securable to said laminar coin cell chamber member;

a coin cell and LED holder bonded to said backing member;

a light-emitting diode installed within said coin cell and LED holder;

a coin cell installed within said coin cell and LED holder; and a switch and circuitry for coupling said light-emitting diode to said electro-chemical power supply.

2. The light module of claim 1, wherein said switch and circuitry are provided by a film member which at least partially covers said laminar coin cell chamber member portion and leads of said light-emitting diode, said film member, when pressed, causing said leads of said light-emitting diode to make physical contact with opposite sides of said coin cell.

3. The light module of claim 1, wherein said backing member is secured to said laminar coin cell chamber member with at least two self-tapping screws.

4. The light module of claim 1, wherein said backing member has an aperture through which light from the light-emitting diode is projected.

* * * * *